United States Patent [19]

Wollam et al.

[11] 4,348,849

[45] Sep. 14, 1982

[54] STARTER STRIP FOR HORIZONTAL SIDING PANELS

[75] Inventors: Carl A. Wollam, Cortland; Lynn Gailey, Newton Falls, both of Ohio

[73] Assignee: Alcan Aluminum Corporation, Cleveland, Ohio

[21] Appl. No.: 177,091

[22] Filed: Aug. 11, 1980

[51] Int. Cl.[3] ..... E04D 1/34

[52] U.S. Cl. ..... 52/545

[58] Field of Search ..... 52/557–562, 52/518, 519, 520, 521, 551, 545, 546, 529, 530, 531, 543, 544, 552–557

[56] References Cited

U.S. PATENT DOCUMENTS

| | | | |
|---|---|---|---|
| 3,157,965 | 11/1964 | Watson | 52/394 |
| 3,363,380 | 1/1968 | Merrill | 52/530 |
| 4,054,012 | 10/1977 | Paradisi | 52/519 |
| 4,079,562 | 3/1978 | Englert | 52/545 |
| 4,272,576 | 6/1981 | Britson | 52/551 |

*Primary Examiner*—John E. Murtagh

*Attorney, Agent, or Firm*—Cooper, Dunham, Clark, Griffin & Moran

[57] ABSTRACT

A starter strip for anchoring, to a wall, the bottom margins of the lowermost course of an array of horizontally elongated siding panels each secured to the wall along its top margin and each having an inwardly projecting, upwardly opening channel flange along its bottom margin. The starter strip includes a leg mountable on the wall, a locking flange arranged to be received within the channel flanges of the panels, and resilient biasing means such as a spring leg for acting against the inner surfaces of the panels to urge the bottom margins of the panels outwardly and thereby to hold the inner legs of their channel flanges against the inner edge of the locking flange.

6 Claims, 3 Drawing Figures

STARTER STRIP FOR HORIZONTAL SIDING PANELS

DESCRIPTION

BACKGROUND OF THE INVENTION

This invention relates to a starter strip for use in installing horizontally elongated siding panels such as are mounted in overlapping parallel courses on an exterior building wall to provide a protective and attractive covering for the wall.

In one known type of horizontal siding panel, with which the presennt invention is particularly concerned, the bottom margin of each panel is bent inwardly and then upwardly to form an inwardly projecting, upwardly opening longitudinal channel flange or butt flange with an upstanding inner leg, and the top marginal portion of the panel is shaped to provide an outwardly and downwardly projecting longitudinal lip. As installed on a wall in overlapping array, the panels of each course are secured to the wall at their top margins, e.g. by gasteners such as nails driven through a nailing flange portion of the panel top margin above the lip; the butt flanges of the panels of each course (except the lowermost course) overlap the top margin of the next lower source of panels, concealing the fasteners of the lower course, and receive and interlockingly engage the lips of the lower-course panels so that every panel is effectively anchored to the wall along both top and bottom margins. Since the butt flange of each panel holds the panel lower margin away from the wall, the exposed (outwardly facing) major surfaces of the panels slope downwardly and outwardly, simulating the appearance of conventional wooden clapboards or rows of shingles. These panels, commonly roll-formed from sheet metal (e.g. aluminum) strip or molded of plastic (e.g. vinyl), may be eight inches or more in vertical height and as much as twelve feet or more in horizontal length.

Installation of panels of the described type on a wall involves mounting progressively higher courses in succession, one above another, the butt flanges of each higher course being interlocked with the lips of the already-mounted next lower course before the top margins of the higher-course panels are nailed to the wall. The panels of the lowermost course (which are mounted first), however, have no subjacent panel lips with which to interlock. Accordingly, it is customary to mount a so-called starter strip along the bottom of the wall (prior to installing the panels) for anchoring the butt flanges of the lowermost course of panels, thereby to prevent undesired displacement of the bottom margins of these panels. Typically, the starter strip is a horizontally elongated, roll-formed sheet metal (or molded plastic) member, having an upper longitudinal portion which lies flat against and is nailed to the wall, and a lower longitudinal portion shaped to be received within, and interlockingly engaged by, the butt flanges of the lowermost course of panels, which overlap and conceal the starter strip when the panels are installed. This lower portion of the starter strip may be disposed at, or may project below, the bottom of the wall, depending on the level at which it is desired to position the bottom margin of the panel array relative to the wall.

Conventional starter strips, as heretofore used, have had various disadvantages. Commonly, they are so designed that the panel butt flanges engage them only loosely; thus the panels tend to rattle undesirably against the starter strip, especially when the starter strip projects below the bottom edge of a wall, and in some cases the panels may even become disengaged from the starter strip as a result of thermal changes or settling of the building on which they are mounted. In addition, installation of the lowermost course of panels is difficult, because the loosely engaged starter strip does not maintain the panels in position for nailing their top margins, and the instaler must accordingly hold in place a panel that may be many feet in length while performing the nailing operation. It would be beneficial to provide a starter strip that firmly and securely holds the panel butt flanges that engage it; however, known types of starter strips shaped and dimensioned to be snugly received within the butt flange of a panel require impracticably close manufacturing tolerances, do not permit lateral movement of the panels or accommdoate thermal expansion and contraction, are not capable of use with panels of different butt widths, and present problems for the instaler in that it has been difficult to insert the butt flange of a panel properly under and around the starter strip.

SUMMARY OF THE INVENTION

The present invention broadly contemplates the provision of a starter strip, for anchoring to a wall the bottom margins of at least one horizontal siding fpanel of the above-described type, comprising a leg mountable on the wall; a locking flange, connected to the starter strip leg, positioned and dimensioned to be received in the panel channel flange and having an inner edge, spaced from the starter strip leg, for bearing against the upstanding leg of the channel flange; and resilient biasing means, receivable with the locking flange in the panel channel flange and disposed to act against the inwardly-facing major surface of the panel adjacent the bottom of the channel flange, for uging the last-mentioned panel surface outwardly, thereby to hold the upstanding leg of the channel flange against the inner edge of the blocking flange when the locking flange is received in the channel flange.

As a further particlar feature of the invention, the resiliwent biasing means comprises a depending spring leg having a free, outwardly projecting lower end for engaging thwe aforementioned inwardly-facing panel major surface, so disposed in relation to the inner edge of the locking flange tht the horizontal distance between that edge and the free end of the spring leg, when the spring leg is uncompressed, is greater than the width of the panel channel flange. Thus, when the locking flange and spring leg are received within the channel flange of a panel, the free end of the spring leg is compressed inwardly by the inwardly-facing panel major surface. It will be understood that the terms "inwardly" and "outwardly," as used herein, refer to directions respectively toward and away from the wall surface on which the panel is mounted.

Advantageously, the starter strip leg, locking flange and spring leg are formed integrally from a single continuous horizontally elongated sheet or strip of resiliently deformable material such as a metal, e.g. aluminum, or a suitable plastic, e.g. vinyl. Each of the strip portions constituting the strip leg, locking flange and spring leg is accordingly horizontally elongated, and in particular, the inner edge of the locking flange continuously engages the upstanding leg of the channel flange along the length thereof so as to provide a continuous seal between the panel and the wall at the panel bottom margin.

In the described starter strip, the width of the locking flange is less than the width of the panel channel flange, so that the channel flange can be readily fitted around the locking flange by overcoming the resilient biasing force of the spring leg; i.e. as a panel is mounted on the starter strip, the spring leg is compressed inwardly. The spring leg then acts against the panel to hold the panel securely engaged with the starter strip so that the panel bottom margin is not loose and is effectively restrained from rattling; at the same time, the yieldable engagement of the spring leg with the panel permits lateral movement of the panel relative to the starter strip for adjustment during installation, and to accommodate thermal expansion and contraction. Most significantly, the spring leg provides an accurately conforming fit of the starter strip to panel channel flanges without requiring close dimensional tolerances in forming, and indeed the same starter strip can be used with panels having chanel flanges of any of a substantial range of widths. An additional advantage of the invention is that as a panel engaging the starter strip is moved into position for nailing to a wall, the spring leg urges the top margin of the panel against the wall, thereby supporting the panel in place for nailing.

Further features and advantages of the invention will be apparent from the detailed description hereinbelow set forth, together with the accompanying drawing.

DETAILED DESCRIPTION

Figure 1:
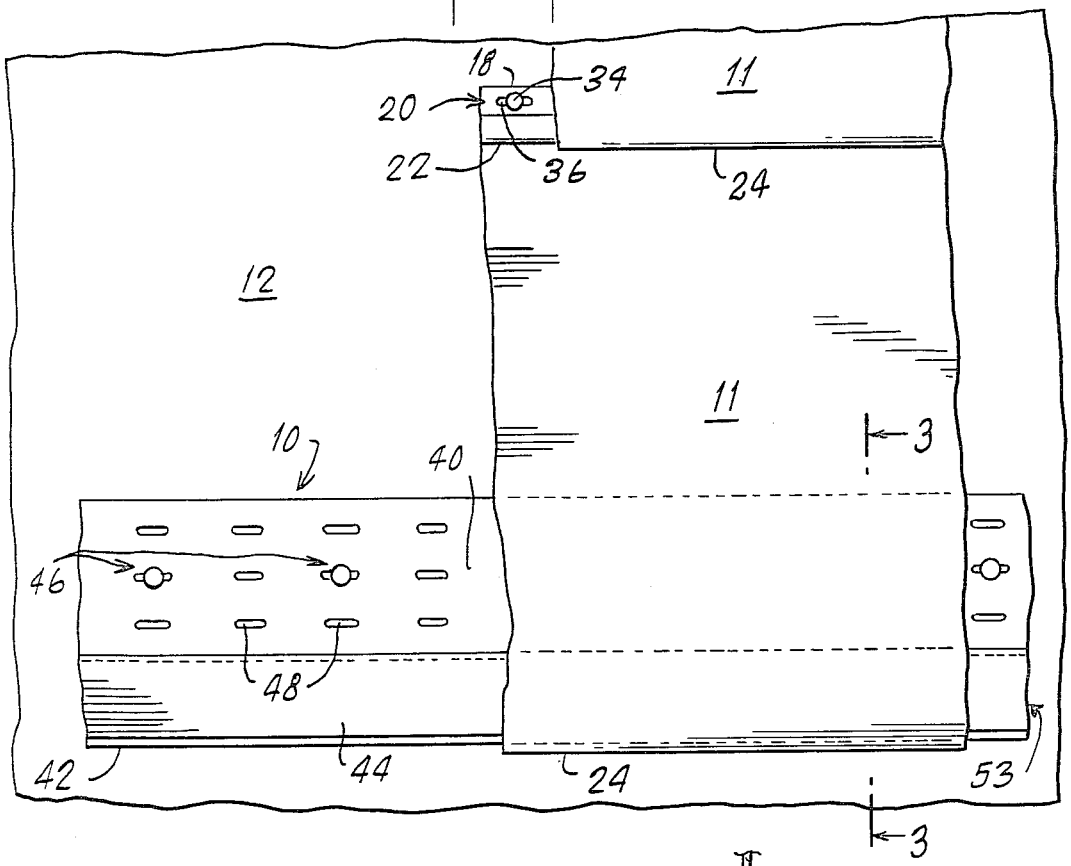
FIG. 1 is a fragmentary front elevational view, partially broken away, of the lower portion of a wall-mounted array of siding panels wherein the lowermost course is anchored at the bottom by a starter strip embodying the present invention in a particular form.

Referring to the drawing the invention is shown as embodied in a starter strip 10 for use with horizontally elongated sliding panels 11 (e.g. roll-formed sheet aluminum panels) designed to be mounted in parallel overlapping course, one above another, on a vertical wall 12. Each panel has outwardly and inwardly facing major surfaces respectively designated 14 and 16 (FIG. 3), a top margin 18 (FIG. 1) including a nailing flange 20 and a downwardly and outwardly profjecting longitudinal lip 22 immediately below the nailing flange, and a bottom margin 24 bent inwardly at 26 and then upwardly at 28 (FIG. 3) to form an inwardly projecting, upwardly opening longitudinal butt or channel flange 30 with an upstanding inner leg 32. The panels of each course are secured to the wall by nails 34 driven through openings 36 formed in the nailing flanges along their top margins; with the exception of the lowermost course, the bottom margins of the panels of each course overlap the top margins of the panels of the next lower course, concealing the nails of the lower-course panels, and the channel flanges 30 of the higher-course panels receive and interlock with the lips 22 of the lower-course panels to anchor the bottom margins of the higher-course panels. All these features of the panels are entirely conventional.

The starter strip 10 of the invention, in its illustrated embodiment, broadly includes a leg 40 mountable on the wall 12, a locking flange 42 connected to the leg 40, and resilient biasing means comprising a spring leg 44, all as hereinafter further described. The starter strip in this embodiment is an integral, unitary, horizontally elongated element, e.g. formed (by generally conventional forming techniques) from a strip of sheet metal such as aluminum.

The leg 40 is the uppermost portion of the strip 10, and is a wide, flat, horizontally elongated flange with vertical major surfaces. When the strip is installed, typically along the bottom edge of a vertical building wall 12, the leg 40 lies flat against the wall and is secured thereto by fasteners such as nails 46 drive into the wall through openings 48 preformed at spaced locations along the leg. Each of the openings 48 is preferably a horizontally elongated slot, to permit lateral movement of the strip 10 relative to the nails 46 and the wall 12 as the strip undergoes thermal expansion and contraction.

Figure 2:
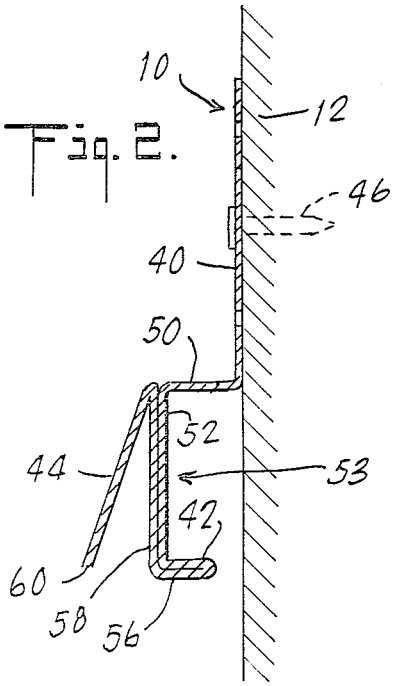
FIG. 2 is an enlarged cross-sectional elevational view of the starter strip of FIG. 1 prior to installation of panels.

Below the leg 40, the strip 10 is bent outwardly along its length into a horizontal plane at 50 (FIG. 2), then downwardly into a vertical plane at 52, and then inwardly again to form the locking flange 42, the strip portions 50 and 52 connecting the flange 42 to the leg 40 and forming, with flange 42, an inwardly opening longitudinal box or channel section 53 depending from the leg 40, with a vertical side portion or surface 52. The locking flange 42 is a horizontal return flange extending along the length of the strip 10 and has a continuous longitudinal inner edge 54 spaced below the leg 40 and spaced outwardly from (but parallel to) the vertical surface plane of the wall 12 on which the strip 10 is mounted. The width, or transverse horizontal dimension, of the locking flange 42 is less than the width of thwe channel flange 30 of a panel 11 (the channel flange width being the horizontal internal dimension between panel surface 16 and upstanding leg 32); thus the locking flange is readily receivable in the panel channel flange 30, edge 54 being disposed to bear against the upstanding leg 32 when the locking flange is located within the channel flange.

At the inner edge 54 of the locking flange, the metal of the strip 10 is bent downwardly and outwrdly through 180° at 56 and then vertically upward at 58 so as to conformingly overlie the outer surfaces of the locking flange 42 and vertical side portion 52 of box section 53, thereby reinforcing the locking flange and providing a rounded configuration for the edge 54. Adjacent the top of box section 53, the metal of the strip is bent again outwardly and downwardly through more than 90° to provide the spring leg 44, which extends along the length of the strip outwardly of the box section (forming a downwardly-opening acute angle with vertical side portion 52) and terminates in a longitudinal lower free end 60 located at approximately the same horizontal level as the locking flange inner edge 54. In the as-formed condition of the strip 10 (FIG. 2), the horizontal distance between the free end 60 of the spring leg 44 and the inner edge 54 of the locking flange 42 is greater than the width of a panel chanel flange 30; however, the metal of the strip 10 is resiliently deformable, enabling the spring leg 44 to be compressed inwardly toward the locking flange, sufficiently to fit therewith in a channel flange 30.

For installation of a panel 11 on the starter strip 10, with the starter strip nailed to the wall 12, the upstanding leg 32 of the panel channel flange 30 is inserted upwardly behind the inner edge 54 of the locking flange 42, so that the locking flange and spring leg 44 are received in the channel flange; this insertion is easily accomplished, owing to the narrow width of the locking flange (relative to the channel flange) and to the resilient compressibility of the spring leg. Tupically, the panel 11 is presented to the starter strip with the major surfaces of the panel oriented at a substantial angle to the vertical, and with the channel flange 30 projecting upwardly; then, as the channel flange lweg 32 engages the inner edge 54 of the locking flange, the panel is rotated upwardly (about an axis substantially coincident with edge 54) until the panel top margin abuts the wall in position for nailing.

Figure 3:
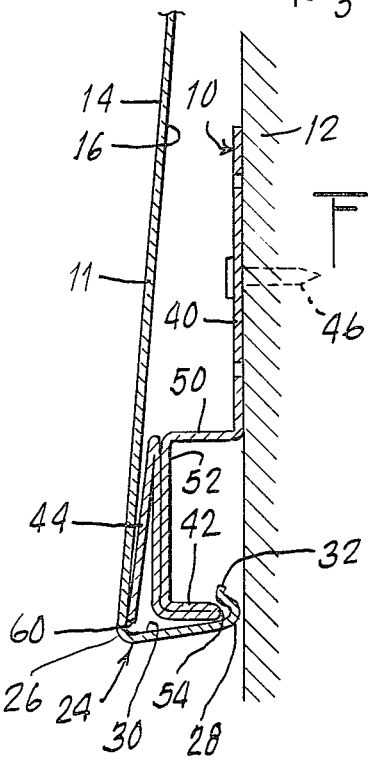
FIG. 3 is a view similar to FIG. 2, taken as along the line 3 —3 of FIG. 1, showing a panel mounted on the starter strip.

When the panel is thus disposed, as shown in FIG. 3, with the starter strip locking flange 42 and spring leg 44 fully received within the channel flange 30 (and the starter strip fully overlapped and concealed behind the lower portion of the panel), the free lower end 60 of the spring leg engages the inwardly facing pahel major surface 16 at or immediately adjacent the inward bend 26 at the bottom of the panel, and the spring leg is compressed inwardly by the panel. Since the spring leg is resilient and is under compression, it exerts an outward biasing or restoring force on the panel at the horizontal line of contact between the spring leg end 60 and the panel surface 16, along the length of the panel. This forces, acting on the panel, urges the upstanding leg 32 of the panel channel flange against the inner edge 54 of the locking flange 42, over the full length of the panel, and thereby holds the channel flange in tight, secure interengagement with the starter strip. Moreover, the force exerted by the spring leg on the panel urges the panel top margin against the wall, becuase the center of gravity of the panel in the FIG. 3 position is substantially over and to the right of the line of contact of the spring leg end 60 therewith, so that the spring force tends to move the panel top margin in a clockwise direction as seen in FIG. 3. Thus, the starter strip serves to support the panel in position for nailing the panel top margin to the wall, significantly facilitating installation of the panel; yet the resiliency of the spring leg enables the installer to move the panel in a lateral direction, if necessary, to locate the panel properly along the wall after the channel flange is engaged with the starter strip.

Once the panel has been fully installed, the spring leg 44 continues to hold the channel flange in the above-described tight, secure interengagement with the starter strip, and consequently prevents the panel from rattling (regardless of whether the panel bottom margin and the starter strip locking flange are disposed outwardly of the wall 12, as shown, or below the bottom edge of the wall), while accommodating settling of the building, and thermal expansion and contraction, without impairment of the desired tight fit between the channel lwange and starter strip; hence there is no likelihood that the panel will become disengaged from the starter strip. The continuous engagement of the upstanding leg 32 with the locking flange edge 54 throughout the length of the panel also advantageously seals the space between the panel and the wall. These beneficial results are achieved without requiring accurate forming of either the panel channel flange or the starter strip to close dimensional tolerances; on the contrary, the same starter strip fits panels having different chanel flange widths, over a substantial range of such widths.

Ordinarily, the starter strip 10, or a succession of lengths of the starter strip mounted end to end in horizontal alignment, are used to secure an entire course of the panels 11, viz. the lowermost course of an array of the panels. With the lowermost course of panels installed as described above, installation of successively higher courses in the array can proceed in a wholly conventional manner.

Althiough in its illustrated embodiment, the starter strip of the invention has a spring leg formed integrally with the other portions of the strip, the spring leg can be a separate element, mounted or positioned in appropriate relation to the locking flange. Alternatively, other forms of resilient biasing means can be provided for the starter strip, e.g. spring clips struck out from the starter strip at intervals along its length.

It is to be understood that the invention is not limited to the features and embodiments hereinabove specifically set forth, but may be carried out in other ways without departure from its spirit.

We claim

1. For use with a wall-mounted array of overlapping parallel courses of horizontally elongated siding panels mounted one above another on a wall, each of said panels having outwardly and inwardly facing major surfaces, a top margin securable to the wall, and a bottom margin bent inwardly and upwardly to form an inwardly projecting, upwardly opening longitudinal channel flange with an upstanding inner leg, a starter strip for anchoring the bottom margin of at least one panel of the lowermost of the courses to the wall, said starter strip comprising:

(a) a leg mountable on the wall;

(b) a locking flange connected to the starter strip leg, positioned and dimensioned to be received in the channel flange of said one panel and having an inner dge, spaced from the starter strip leg, for bearing against the upstanding leg of the channel flange; and (c) resilient biasing means, receivable with the locking flange in the panel channel flange and disposed to act against the inwardly-facing surface of said one panel adjacent the bottom of the channel flange of the panel, for urging the last-mentioned panel surface outwardly, thereby to hold the upstanding leg of the panel chanel flange against said locking flange inner edge when the locking flange is received in the channel flange;

(c) said biasing means comprising a depending spring leg having a free, outwardly projecting lower end for engaging the aforesaid inwardly-facing panel surface, said lower end of said spring leg being so disposed that said spring leg is compressed inwardly by the panel when said spring leg and said locking flange are received in the panel channel flange.

2. A starter strip as defined in claim 1, wherein said mountable leg, said locking flange, and said spring leg are formed integrally from a horizontally elongated strip of resiliently deformable material.

3. A starter strip as defined in claim 2, wherein said inner edge of said locking flange is arranged for continuous engagement with the upstanding leg of the aforesaid panel chanel flange along the length thereof.

4. A starter strip as defined in claim 3, wherein the starter strip leg is a flat horizontally elongated upper portion of the strip with vertical major surfaces, arranged to lie flat against the wall and to be fastened thereto; wherein the strip, below the last-mentioned leg, is bent horizontally outwardly, then vertically downwardly, and then horizntally inwardly to form an inwardly opening longitudinal box section having a vertical outer side, said locking flange being the bottom portion of said box section; and wherein said spring leg projects downwardly and outwardly from an upper locality of said box section.

5. A starter strip as defined in claim 4, wherein said strip is bent downwardly and outwardly through 180° at said inner edge of said locking flange, such that said inner edge is rounded, said strip then being bent upwardly to overlie said vertical side of said box section, and being then bent downwardly and outwardly adjacent the top of said box section to form said spring leg, said spring leg being oriented at a downwardly-opening acute angle to said vertical side of said box section.

6. The combination, with at least one horizontally elongated siding panel mounted on a wall and having inwardly and outwardly facing major surfaces, a top margin secured to the wall, and a bottom margin bent inwardly and upwardly to form an inwardly projecting, upwardly opening longitudinal channel flange with an upstanding inner leg, of a starter strip anchoring the bottom margin of the panel to the wall, said starter strip comprising:

(a) a leg mounted on the wall;

(b) a locking flange connected to the starter strip leg, disposed in said panel channel flange and having an inner edge, spaced from the starter strip leg and from the wall, bearing against the upstanding leg of the channel flange, the width of said locking flange being less than the width of the channel flange; and (c) resilient biasing means, disposed under compression in the channel flange outwardly of the locking flange and acting against said inwardly-facing panel surface adjacent the bottom of the channel flange for urging the last-mentioned panel surface outwardly, thereby to hold the upstanding leg of the panel channel flange against said locking flange inner edge;

(d) said biasing means cpmprising a depending spring leg having a free, outwardly projecting lower end for engaging the aforesaid inwardly-facing panel surface, said lower end of said spring leg being so disposed that said spring leg is compressed inwardly by the panel when said spring leg and said locking flange are received in the panel channel flange.

* * * * *

UNITED STATES PATENT AND TRADEMARK OFFICE

CERTIFICATE OF CORRECTION

PATENT NO. : 4,348,849

DATED : September 14, 1982

INVENTOR(S) : Carl A. Wollam and J. Lynn Gailey

It is certified that error appears in the above-identified patent and that said Letters Patent are hereby corrected as shown below:

First page, item [75] ("Inventors"), "Lynn Gailey" should read --J. Lynn Gailey-- .

Col. 1, line 23, "gasteners" should read --fasteners-- .

Col. 2, line 27, "fpanel" should read --panel-- ;

line 46, "thwe" should read --the-- ;

line 48, "tht" should read --that-- .

Col. 3, line 50, "course" should read --courses-- .

Col. 4, line 39, "thwe" should read --the-- .

Col. 5, line 9, "Tupically" should read --Typically-- ;

line 13, "lweg" should read --leg-- ;

line 24, "pahel" should read --panel-- ;

line 59, "lwange" should read --flange-- .

Col. 6, line 39, "dge" should read --edge-- .

Col. 8, line 18, "cpmprising" should read --comprising-- .

Signed and Sealed this

*Seventeenth* Day of *July 1984*

[SEAL]

*Attest:*

GERALD J. MOSSINGHOFF

*Attesting Officer*

*Commissioner of Patents and Trademarks*